United States Patent [19]

Salzgeber et al.

[11] Patent Number: 4,793,311

[45] Date of Patent: Dec. 27, 1988

[54] FUEL INJECTION PUMP WITH MULTI-STATE LOAD/SPEED CONTROL SYSTEM

[75] Inventors: Daniel E. Salzgeber, Windsor; George Woliver, Wallingford; Alan F. Lasher, Ellington, all of Conn.

[73] Assignee: Stanadyne, Inc., Windsor, Conn.

[21] Appl. No.: 120,197

[22] Filed: Nov. 4, 1987

Related U.S. Application Data

[63] Continuation of Ser. No. 825,632, Feb. 3, 1986, abandoned.

[51] Int. Cl.[4] ..... F02M 39/00

[52] U.S. Cl. ..... 123/450; 123/179 L; 123/458; 417/462

[58] Field of Search ..... 123/385, 386, 387, 458, 123/450, 462, 446; 417/462, 253

[56] References Cited

U.S. PATENT DOCUMENTS

| | | | |
|---|---|---|---|
| 3,219,020 | 11/1965 | Roosa | 123/387 |
| 4,083,345 | 4/1978 | Davis | 123/450 |
| 4,142,499 | 3/1979 | Salgeder | 123/339 |
| 4,201,170 | 5/1980 | Overfield | 123/450 |
| 4,333,437 | 6/1982 | Lottner | 123/179 L |
| 4,397,615 | 8/1983 | Mowdray | 123/450 |
| 4,457,277 | 7/1984 | Adey | 123/387 |
| 4,539,956 | 9/1985 | Mengel | 123/458 |
| 4,552,117 | 11/1985 | Djordjevic | 123/450 |
| 4,574,759 | 3/1986 | Ledlaing | 123/387 |

*Primary Examiner*—Carl Stuart Miller

*Attorney, Agent, or Firm*—Chilton, Alix & Van Kirk

[57] ABSTRACT

A fuel injection pump having an inlet metering valve with separate primary and boost ports for metering an intake charge of fuel to a charge pump, limit means for separately establishing a maximum charge limit of the charge pump and a lesser metered charge limit through the primary valve port, a multiple position hydraulic actuator for selectively setting an all-speed governor at each of a plurality of speed settings and a solenoid control for selectively positioning the hydraulic actuator and activating the boost port to switch the charge limit to said maximum limit at certain speed settings.

17 Claims, 2 Drawing Sheets

FUEL INJECTION PUMP WITH MULTI-STATE LOAD/SPEED CONTROL SYSTEM

This is a continuation of co-pending application Ser. No. 825,632, filed on Feb. 3, 1986, now abandoned.

BACKGROUND AND BRIEF SUMMARY OF THE INVENTION

The present invention relates generally to fuel injection pumps for internal combustion engines for sequentially supplying measured charges of fuel under high pressure for fuel injection and relates more particularly to a new and improved multi-state load/speed control system for a fuel injection pump for setting the speed and/or maximum load limit of the pump.

In conventional fuel injection pumps of the type to which the present invention has notable application, a suitable throttle operated governor is employed for controlling the speed of the associated engine. In some constant speed applications, for example in constant speed industrial applications, the engine is normally operated only at several speeds at the usual operating modes of the engine. Also, for example in some constant speed industrial applications, it is desirable to temporarily increase the maximum load limit of the pump to provide a temporary increase in the maximum drive torque of the engine.

Accordingly, it is a principal aim of the present invention to provide in a fuel injection pump, a new and improved multi-state load/speed control system for selectively setting different speeds and maximum load limits of the pump.

It is another aim of the present invention to provide in a fuel injection pump, a new and improved multi-state load control system for selectively setting different pre-established maximum load limits of the pump.

It is a further aim of the present invention to provide in a fuel injection pump of the type described having a fuel metering valve adjustable to vary the inlet fuel flow rate and thereby to vary the size or quantity of the injected charge, a new and improved load control system for varying the fuel flow rate through the metering valve independently of the metering valve setting.

It is another aim of the present invention to provide in a fuel injection pump of the type having an all speed governor, a new and improved speed control system for selecting different governor speed settings.

Other objects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENT

Figure 1:
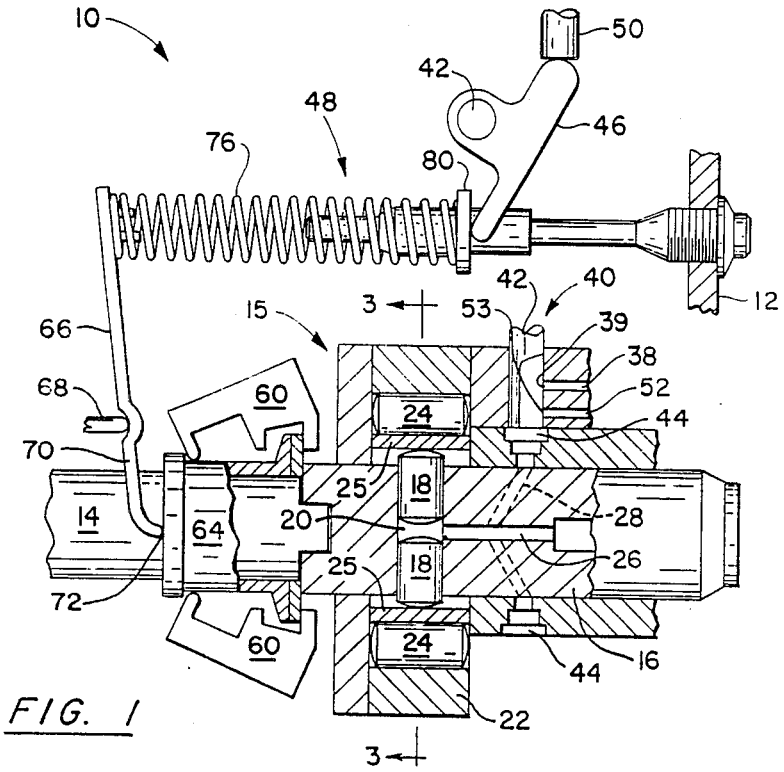
FIG. 1 is a partial longitudinal section view, partly broken away and partly in section, of a fuel injection pump having a multi-state load/speed control system incorporating an embodiment of the present invention.
Figure 3:
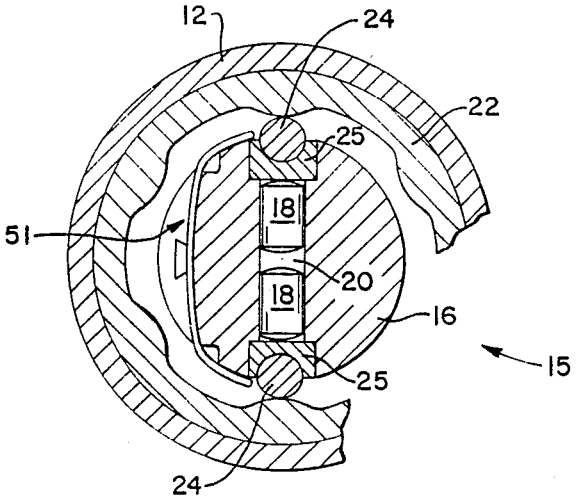
FIG. 3 is a partial transverse section view, partly broken away and partly in section, of the fuel injection pump.

With reference to the drawings wherein like numerals represent like parts throughout, a multi-state load/speed control system incorporating an embodiment of the present invention is shown employed in a fuel injection pump 10 of the type disclosed in U.S. Pat. No. 4,142,499, dated Mar. 6, 1979, and entitled "Temperature Compensated Fuel Injection Pump" and the pump 10 may be identical to the pump disclosed in U.S. Pat. No. 4,142,499 except as otherwise described herein.

Briefly, the pump 10 has a rotor 16 with a drive shaft 14 to couple the rotor 16 to be driven by an associated internal combusion engine (not illustrated). A high pressure charge pump 15 of the pump 10 has a pair of pumping plungers 18 reciprocable in a diametral bore of the rotor 16 for pumping fuel from a pump chamber 20 formed between the plungers 18. A pair of rollers 24 and roller shoes 25 are mounted in radial alignment with the plungers 18, and a cam ring 22 encircling the plungers 18 and rollers 24 is engageable by the rollers 24 for periodically camming the plungers inwardly during rotation of the rotor 16. The angular position of the cam ring 22 is adjusted by a hydraulic timing piston (not illustrated) for regulating the timing of the inward pumping stroke of the plungers 18.

The rotor 16 has a central axial bore 26 and diagonal inlet passages 28 for supplying fuel to the pump chamber 20 during the outward intake stroke of the pumping plungers 18. During each inward pumping stroke of the plungers 18, pressurized fuel is delivered via the axial bore 26 to a distributor passage (not illustrated) which registers sequentially with outlet passages (not illustrated) for sequentially deliverying pressurized charges of fuel to the injection nozzles (not illustrated) of the associated internal combustion engine.

Figure 2:
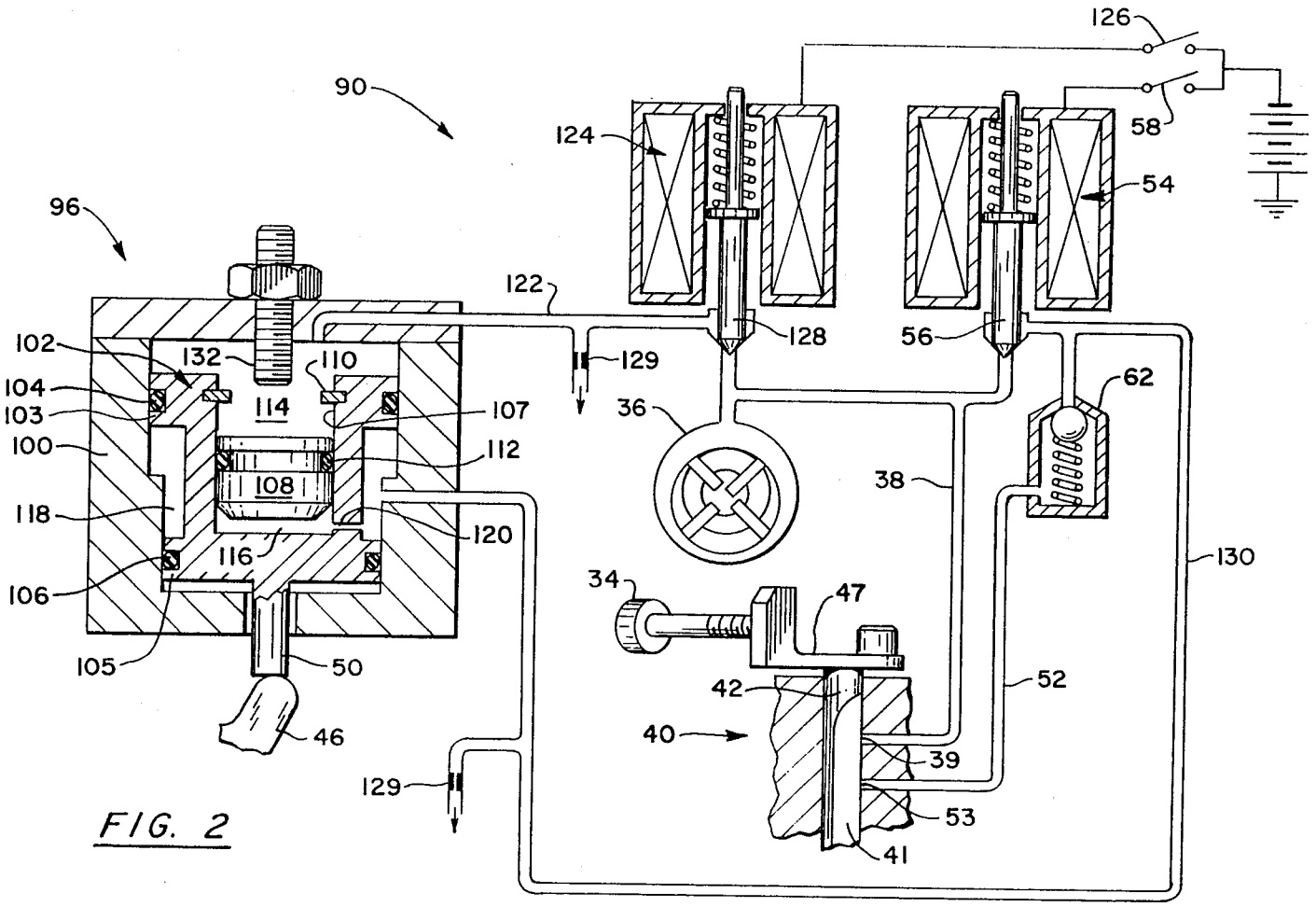
FIG. 2 is a generally diagrammatic view, partly broken away and partly in section, of the multi-state control system.

A vane-type transfer pump 36 (FIG. 2) supplies fuel under transfer pressure from a fuel tank (not illustrated) through a transfer passage 38 to a primary valve port 39 of an inlet metering valve 40. The inlet metering valve 40 has a rotary valve member 42 with a recess 41 and provides for metering fuel to the pump chamber 20 (during each outward charging or intake stroke of the pumping plungers 18) in accordance with the angular position of the valve member 42.

The outward stroke of the plungers 18 and therefore the maximum load or quantity of fuel delivered to the pump chamber 20 is limited by an adjustable leaf spring 51 mounted on the rotor 16 for engagement by the plunger shoes 25. In addition, an adjustable torque screw or stop 34 is provided for engagement by a valve lever arm 47 for establishing the open limit position of the valve member 42 and therefore the minimum restriction presented by the valve member 42 to the flow of fuel to the pump chamber 20. The stop screw 34 is manually adjustable at the exterior of the pump and is manually set to limit the fuel charge metered through the primary valve port 39 to less than the maximum fuel charge permitted by the leaf spring 51.

In accordance with the present invention, a multi-state control system 90 is provided for setting the all-speed governor 48 and selecting one of the preestablished maximum load limits provided by the leaf spring 51 and torque screw 34. In the disclosed embodiment, the speed and load control subsystems are integrated into the single system 90 for selecting three speeds and the two preestablished maximum load limits.

The load control subsystem employs a metering valve boost port 53 for metering additional fuel to the pump chamber 20 with the metering valve member 42. The boost port 53 is axially spaced from the primary valve port 39 and in the disclosed embodiment the valve recess 41 is configured so that the metering valve member 42 presents substantially the same restriction to the boost port 53 as it does to the primary valve port 39.

A solenoid valve 54, suitably mounted on the pump housing 12, provides for selectively connecting the transfer passage 38 to a boost passage 52 leading to the boost port 53. The solenoid valve 54 is energized by a switch 58 to retract a valve member 56 against its closure spring to open the valve 54. Switch 58 may be remotely located, for example in the operator compartment of a vehicle in which the control system 90 is installed.

A one-way check valve 62 is provided in the fuel boost passage 52 to prevent reverse flow of fuel from the metering valve 40 via the boost port 53 when the solenoid valve 54 is closed. Check valve 62 preferably comprises a spring biased ball valve having a relatively low opening pressure.

When the solenoid 54 is deenergized, a lower maximum load limit is established by the setting of the torque screw 34. When a greater load is required, a higher maximum load limit can be selected by energizing the solenoid 54 with the switch 58. Fuel under transfer pressure is then supplied to the boost port 53 to provide additional metered fuel to the pumping chamber 20. The higher maximum load limit established by the leaf spring 51 is then effective. Thus, the switch 58 s operable to select boost and non-boost modes of operation and corresponding maximum load limits at two different preset levels.

The speed control subsystem employs a multi-state linear actuator 96 for operation of the all speed governor 48. As hereinafter more fully explained, the linear actuator 96 is selectively hydraulically operated to set the governor at each of three preestablished speed settings.

The all speed governor 48 adjusts the angular position of the valve member 42 to control the engine speed in accordance with the speed setting of the throttle lever 46. The all speed governor 48 may be identical to the all-speed governor disclosed in U.S. Pat. No. 3,219,020, dated Nov. 23, 1965, and entitled "Pump Regulator" and therefore is not described herein in detail. Briefly however, the governor 48 has a plurality of governor weights 60 which provide a speed related bias, transmitted via a sleeve 64 which engages the inner end 72 of a pivotal governor plate 66, to urge the governor plate 66 in a clockwise pivotal direction as viewed in FIG. 1 about its pivot 68. The governor plate 66 is urged in the opposite or counterclockwise pivotal direction as viewed in FIG. 1, by a governor spring 76 mounted between a slide 80 and the governor plate 66. The counterclockwise bias of the governor spring 76 is adjusted by axially adjusting the slide 80 with the pivotal throttle lever 46. As disclosed in the aforementioned U.S. Pat. Nos. 4,142,499 and 3,219,020, the governor plate 66 is connected to angularly position the metering valve member 42 in accordance with the pivotal position of the governor plate 66 and therefore in accordance with the opposing forces on the governor plate produced by the governor weights 60 and governor spring 76.

The linear actuator 96 comprises a hydraulic cylinder 100 suitably mounted on the pump housing 12 above the governor 48 so that a throttle actuating rod 50 is aligned for engagement with an upper arm of the throttle lever 46. The cylinder 100 has a stepped bore receiving a throttle piston 102 having an axial extension forming the actuating rod 50.

The throttle piston 102 has a pair of axially spaced, peripheral, circular flanges 103, 105 received within the upper larger and lower smaller bore sections of the cylinder 100. O-ring seals 104, 106 are provided within peripheral annuli in the flanges 103, 105 for sealing engagement with the cylinder walls of the respective bore sections. An internal piston 108 is mounted within a blind, upwardly opening, coaxial bore 107 in the throttle piston 102 for reciprocable movement between a lower end wall of the piston 102 and an upper limit ring 110. An O-ring seal 112 is mounted within a peripheral annulus in the internal piston 108 for sealing engagement with the cylinder wall of the bore 107.

The throttle piston 102 and internal piston 108 form three hydraulic chambers within the cylinder 100. A first upper end chamber 114 is provided at the upper ends of the throttle piston 102 and internal piston 108. A second internal chamber 116 is provided at the inner end of the coaxial bore 107 in the throttle piston 102 between the pistons 102, 108. A third peripheral annulus or chamber 118 surrounding the throttle piston 102 is formed between the peripheral flanges 103, 105 of the throttle piston. A radial bore 120 in piston 102 connects the internal chamber 116 with the annular chamber 118.

Upper chamber 114 is connected to the transfer pump 36 via a passage 122 and a high engine speed solenoid valve 124. Solenoid valve 124 is preferably mounted on the pump housing 12 adjacent the solenoid valve 54 and is operated by a high speed switch 126 mounted adjacent the switch 58. A valve member 128 of the high speed solenoid valve 124 is spring biased to its closed position to disconnect the transfer pump 36 from the upper chamber 114. When the high speed solenoid valve 124 is energized by closing the switch 126, fuel under transfer pressure is supplied to the upper chamber 114 to hydraulically actuate the throttle piston 102 to its lower limit, high speed position providing a predetermined relatively high speed governor setting.

A low speed governor setting is effected when the throttle piston 102 is axially displaced to its upper limit position. When both solenoid valves 54, 124 are deenergized, a throttle piston 102 is spring actuated to its upper limit low speed position by the force of the governor spring 76. If desired, the throttle lever 46 can then be manually positioned with its support shaft 42 in a conventional manner to control the engine speed throughout the full speed range of the governor 48.

The high speed and idle speed settings may be made adjustable by providing suitable adjustable stops (for example like a stop 132 provided for adjusting an intermediate governor speed setting as hereinafter described) which establish the lower and upper limit positions of the throttle piston 102 within the cylinder 100. Otherwise, the cylinder end walls provide for establishing those limit positions.

The intermediate governor speed setting is effected when only the solenoid valve 54 is energized. Fuel at transfer pressure is then supplied only to the annular chamber 118 and internal chamber 116. The internal piston 108 is hydraulically actuated upwardly into engagement with the ring 110 and the throttle piston 102 is hydraulically actuated upwardly until the internal piston 108 engages the adjustable stop screw 132. For that reason, the effective area of the internal piston 108 is made greater than the effective differential area between the peripheral flanges 103, 105 of the throttle piston 102.

Each solenoid valve 54, 124, when deenergized, suitably provides for connecting the respective chamber 118, 114 to the low pressure cavity of the pump housing 12, for example via a suitable return port (not illustrated) provided in the solenoid valve 54, 124. Alternatively, suitable orifices 129 may be employed for exhausting fuel from the chambers 114, 118 to the housing cavity when the solenoid valves are deenergized.

At the intermediate speed setting, since the solenoid valve 54 is energized, additional fuel is available via the fuel boost port 53 if and when needed.

While at the intermediate speed level, upon closure of the high speed switch 126, the throttle piston 102 is hydraulically actuated to provide the high speed governor setting. If the solenoid valve 54 remains energized, the higher load limit remains available at the high speed setting. Thus, the two preset maximum load limits may be selected with the switch 56 at the high speed setting. For example, in an engine driven generator application, the intermediate speed would be used for engine warm-up or stand-by power during periods when a load was frequently switched on and off. The high speed would be used for generating power, and the secondary (high) fuel level would be used for momentarily providing excess power for excess power requirements. The low speed is used for idle operation or cool-down prior to shut-down.

In summary, a three-state speed control is provided having, for example, low speed, intermediate speed and high speed settings. In addition, a fuel boost mode may be selectively used at the high speed setting. Only two electrically operated solenoid valves are required for implementing the control. If desired, a boost system employing the solenoid valve 54 could be used independently of the speed control system, or a speed control system could be employed without the additional boost port 53.

While a preferred embodiment of the foregoing invention has been set forth for purposes of illustration, various modifications, alternatives and adaptations may occur to one skilled in the art without departing from the spirit and scope of the invention.

We claim:

1. In an internal combustion engine fuel injection pump having a fuel charge pump with a fuel intake stroke for receiving an intake charge of fuel and a fuel pumping stroke for pumping the charge of fuel for fuel injection, an inlet metering valve for variably metering fuel to the charge pump during its intake stroke and a fuel supply pump for supplying fuel under pressure to the metering valve, the metering valve having a primary port for supplying fuel to the charge pump and a valve member adapted to be variably positioned for variably metering the supply of fuel through said primary port to the charge pump, the improvement wherein the metering valve has a boost port for supplying additional fuel to the charge pump, wherein the valve member meters the supply of fuel through the boost port to the charge pump in accordance with the valve member position, and wherein the fuel injection pump further comprises control means for selectively activating the boost port for supplying additional fuel to the charge pump.

2. A fuel injection pump according to claim 1 wherein the charge pump comprises stroke limit means for limiting the intake stroke of the charge pump, thereby to limit the intake charge quantity of fuel, and wherein the metering valve comprises valve limit means for limiting the valve member position for limiting the quantity of fuel supplied to the charge pump through said primary port to less than the quantity limit provided by said stroke limit means.

3. A fuel injection pump according to claim 2 wherein the valve member is a rotary valve member adapted to be rotated in opposite opening and closing direction and wherein the valve limit means is adjustable to adjustably limit the open position of the valve member.

4. A fuel injection pump according to claim 1 wherein said control means comprises a solenoid valve.

5. A fuel injection pump according to claim 1 further comprising a one-way valve for said boost port to prevent reverse fuel flow through said boost port.

6. A fuel injection pump according to claim 1 further comprising an all-speed governor settable for setting the governed speed of an associated internal combustion engine and connected to position said valve member to govern the speed of the associated engine.

7. A fuel injection pump according to claim 6 further comprising a hydraulic actuator operatively connected for setting the governor and adapted to be selectively hydraulically controlled to each of a plurality of operating positions thereof for setting the governor at each of a plurality of settings thereof respectively.

8. A fuel injection pump according to claim 7 wherein the actuator has a first hydraulic chamber for hydraulically actuating the actuator to a first operating position thereof for setting the governor at a first setting thereof and wherein the control means is operable, when activating said boost port, for connecting the supply pump for supplying fuel under pressure to said first chamber for actuating the actuator to its said first operating position.

9. A fuel injection pump according to claim 8 wherein the actuator has a second hydraulic chamber for hydraulically actuating the actuator to a second operating position thereof for setting the governor at a second setting thereof and wherein the control means is selectively operable for selectively connecting the supply pump for supplying fuel under pressure to said second chamber.

10. A fuel injection pump according to claim 9 wherein the hydraulic actuating force of the fuel pressure in said second chamber is greater than the hydraulic actuating force of the fuel pressure in said first chamber to set the governor at said second speed setting when the supply pump is connected to supply fuel under pressure to both of said chambers.

11. A method of varying the fuel intake charge limit of a fuel charge pump of an internal combustion engine fuel injection pump having a fuel charge pump with a fuel intake stroke for receiving an intake charge of fuel and a fuel pumping stroke for pumping the charge of fuel for fuel injection, limit means for limiting the intake stroke of the charge pump to establish a maximum fuel charge limit of the charge pump, an inlet metering valve for variably metering fuel to the charge pump during its intake stroke and a fuel supply pump for supplying fuel under pressure to the metering valve, the metering valve having a supply port for supplying fuel to the charge pump and a valve member adapted to be variably positioned for variably metering the supply of fuel through said supply port to the charge pump, the method comprising the steps of limiting the fuel supplied to the charge pump through said supply port to a second limit which is less than said maximum fuel charge limit, variably metering, with the metering valve member, the supply of additional fuel to the charge pump through an additional port of the metering valve to provide a metering valve limit greater than said maximum limit and selectively activating and deactivating said additional port for selectively supplying said additional fuel to the charge pump.

12. A method according to claim 11 of varying the fuel intake charge limit of a fuel charge pump, wherein the step of selectively activating and deactivating said additional port comprises selectively opening and closing a valve connected in series with said additional port.

13. A method according to claim 11 of varying the fuel intake charge limit of a fuel charge pump, wherein the fuel injection pump has an all-speed governor, and wherein the step of selectively activating said additional port comprises selectively setting the governor speed.

14. A fuel injection pump according to claim 1, wherein the boost port is axially spaced from the metering valve primary port and is configured so that the valve member presents a metering restriction to the boost port commensurate with the metering restriction to the primary port.

15. A fuel injection pump according to claim 2, wherein the stroke limit means includes a leaf spring associated with the fuel charge pump, and said valve limit means comprises an adjustable torque screw associated with the metering valve.

16. A fuel injection pump according to claim 7, wherein said control means is coupled to said hydraulic actuator for selectively and substantially simultaneously activating the boost port and setting a predetermined one of said governor settings.

17. The method according to claim 13, wherein the governor has a spring actuated lower speed setting and a hydraulically actuated higher speed setting, and wherein the step of selectively activating said additional port includes the step of actuating a solenoid to simultaneously activate the additional port and said higher speed governor setting.

* * * * *